US010180637B2

(12) United States Patent
Furukawa

(10) Patent No.: US 10,180,637 B2
(45) Date of Patent: Jan. 15, 2019

(54) IMAGE FORMING APPARATUS

(71) Applicant: Konica Minolta, Inc., Chiyoda-ku, Tokyo (JP)

(72) Inventor: Kunio Furukawa, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 10 days.

(21) Appl. No.: 15/701,622

(22) Filed: Sep. 12, 2017

(65) Prior Publication Data

US 2018/0074428 A1 Mar. 15, 2018

(30) Foreign Application Priority Data

Sep. 15, 2016 (JP) ..... 2016-180171

(51) Int. Cl.
*G03G 15/02* (2006.01)
*G03G 15/00* (2006.01)

(52) U.S. Cl.
CPC ..... *G03G 15/0283* (2013.01); *G03G 15/5037* (2013.01); *G03G 15/0233* (2013.01); *G03G 15/0266* (2013.01)

(58) Field of Classification Search
CPC .. G03G 15/025; G03G 15/80; G03G 15/0216; G03G 15/0266; G03G 15/0283; G03G 15/5004; G03G 15/5033; G03G 15/5037; G03G 2221/1693
See application file for complete search history.

(56) References Cited

U.S. PATENT DOCUMENTS

2007/0189787 A1* 8/2007 Hagiwara ..... G03G 15/0266 399/44
2008/0101807 A1* 5/2008 Burry ..... G03G 15/0216 399/50
2010/0316401 A1* 12/2010 Gomi ..... G03G 15/065 399/49
2015/0117886 A1* 4/2015 Mitsunobu ..... G03G 15/0266 399/50
2016/0231664 A1* 8/2016 Kubo ..... G03G 15/0266
2016/0282745 A1* 9/2016 Komatsu ..... G03G 15/0266

FOREIGN PATENT DOCUMENTS

JP 2003-270910 A 9/2003

* cited by examiner

*Primary Examiner* — Thomas S Giampaolo, II
(74) *Attorney, Agent, or Firm* — Buchanan Ingersoll & Rooney PC

(57) ABSTRACT

An image forming apparatus provided with a charging member to charge a surface of a photoreceptor, includes: a power supply that applies to the charging member a first bias in which an AC voltage is superimposed on a DC voltage or a second bias which is a simple DC voltage; and a hardware processor that causes the power supply to apply the first bias until an amount used of the photoreceptor reaches a predetermined value, and causes the power supply to apply the second bias when the amount used of the photoreceptor reaches the predetermined value.

16 Claims, 10 Drawing Sheets

FIG. 9A

| FILM THICKNESS, EQUAL TO OR MORE THAN 30 μm | | PRINTING SPEED | | | |
|---|---|---|---|---|---|
| | | EQUAL TO OR MORE THAN 300 mm/s | EQUAL TO OR MORE THAN 200 mm/s, AND LESS THAN 300 mm/s | EQUAL TO OR MORE THAN 100 mm/s, AND LESS THAN 200 mm/s | LESS THAN 100 mm/s |
| TEMPERATURE | LESS THAN 10°C | FIRST BIAS | FIRST BIAS | FIRST BIAS | FIRST BIAS |
| | EQUAL TO OR MORE THAN 10°C, AND LESS THAN 20°C | FIRST BIAS | FIRST BIAS | FIRST BIAS | FIRST BIAS |
| | EQUAL TO OR MORE THAN 20°C, AND LESS THAN 30°C | FIRST BIAS | FIRST BIAS | SECOND BIAS | SECOND BIAS |
| | EQUAL TO OR MORE THAN 30°C, AND LESS THAN 40°C | FIRST BIAS | SECOND BIAS | SECOND BIAS | SECOND BIAS |
| | EQUAL TO OR MORE THAN 40°C | SECOND BIAS | SECOND BIAS | SECOND BIAS | SECOND BIAS |

FIG. 9B

| FILM THICKNESS, EQUAL TO OR MORE THAN 20 μm AND LESS THAN 30 μm | | PRINTING SPEED | | | |
|---|---|---|---|---|---|
| | | EQUAL TO OR MORE THAN 300 mm/s | EQUAL TO OR MORE THAN 200 mm/s, AND LESS THAN 300 mm/s | EQUAL TO OR MORE THAN 100 mm/s, AND LESS THAN 200 mm/s | LESS THAN 100 mm/s |
| TEMPERATURE | LESS THAN 10°C | FIRST BIAS | FIRST BIAS | FIRST BIAS | FIRST BIAS |
| | EQUAL TO OR MORE THAN 10°C, AND LESS THAN 20°C | FIRST BIAS | FIRST BIAS | SECOND BIAS | SECOND BIAS |
| | EQUAL TO OR MORE THAN 20°C, AND LESS THAN 30°C | SECOND BIAS | SECOND BIAS | SECOND BIAS | SECOND BIAS |
| | EQUAL TO OR MORE THAN 30°C, AND LESS THAN 40°C | SECOND BIAS | SECOND BIAS | SECOND BIAS | SECOND BIAS |
| | EQUAL TO OR MORE THAN 40°C | SECOND BIAS | SECOND BIAS | SECOND BIAS | SECOND BIAS |

FIG. 9C

| FILM THICKNESS, LESS THAN 20 μm | | PRINTING SPEED | | | |
|---|---|---|---|---|---|
| | | EQUAL TO OR MORE THAN 300 mm/s | EQUAL TO OR MORE THAN 200 mm/s, AND LESS THAN 300 mm/s | EQUAL TO OR MORE THAN 100 mm/s, AND LESS THAN 200 mm/s | LESS THAN 100 mm/s |
| TEMPERATURE | LESS THAN 10°C | FIRST BIAS | FIRST BIAS | SECOND BIAS | SECOND BIAS |
| | EQUAL TO OR MORE THAN 10°C, AND LESS THAN 20°C | SECOND BIAS | SECOND BIAS | SECOND BIAS | SECOND BIAS |
| | EQUAL TO OR MORE THAN 20°C, AND LESS THAN 30°C | SECOND BIAS | SECOND BIAS | SECOND BIAS | SECOND BIAS |
| | EQUAL TO OR MORE THAN 30°C, AND LESS THAN 40°C | SECOND BIAS | SECOND BIAS | SECOND BIAS | SECOND BIAS |
| | EQUAL TO OR MORE THAN 40°C | SECOND BIAS | SECOND BIAS | SECOND BIAS | SECOND BIAS |

IMAGE FORMING APPARATUS

Japanese Patent Application No. 2016-180171 filed on Sep. 15, 2016, including description, claims, drawings, and abstract the entire disclosure is incorporated herein by reference in its entirety.

BACKGROUND

Technological Field

The present invention relates to an image forming apparatus.

Description of the Related Art

In an electrophotographic image forming apparatus in the related art, the following technology has been employed in order to charge a photoreceptor. That is, a voltage is applied to a charging member which is to be brought into contact with the photoreceptor so that a surface of the photoreceptor is charged by proximate discharge. In this technology, the charging member is pressed against the photoreceptor so that the charging member and the photoreceptor come into contact with each other. Application of a bias to the charging member causes the proximate discharge near a contact portion between the photoreceptor and the charging member, and application of an electric charge to the surface of the photoreceptor causes charging of the surface of the photoreceptor.

According to a technology to apply a direct-current bias (DC bias) to the charging member, it is required to set an applied voltage to a high value under conditions disadvantageous for charging such as a case where printing speed is high or a case where a film thickness of the photoreceptor is thick. However, when a gap between a photoreceptor potential before charging and the applied voltage is large, unevenness in charging occurs due to overdischarge, which results in image defects.

In a technology to apply an alternating-current bias (a bias in which an AC bias is superimposed on a DC bias) to the charging member, charging and elimination are repeated so that unevenness in charging does not occur even with overdischarge because of the elimination. However, in the technology to apply the AC bias, an amount of current flowing through the photoreceptor is larger than that in the technology to apply the DC bias, which leads to a problem that wastage due to deterioration of the photoreceptor increases. When the film thickness of the photoreceptor becomes thin due to the wastage, a function to hold the potential deteriorates and noise is generated in an image. Therefore, the photoreceptor needs to be replaced.

In order to solve such problems, the following technique has been proposed (for example, see JP 2003-270910 A). That is, a DC bias is applied to a charging member when an amount used of a photoreceptor is small so as to reduce wastage of the photoreceptor, whereas an AC bias is applied to the charging member when the amount used of the photoreceptor increases and the photoreceptor deteriorates so as to suppress image defects due to cutting unevenness and the like of the photoreceptor.

In order to further prolong the life of a photoreceptor, a film thickness of the photoreceptor may be thickened so as to increase a cutting allowance of a film thickness of the photoreceptor. In such a case, if a DC bias is applied when an amount used of the photoreceptor is small as in the related art, it is required to set a voltage high as described above.

Accordingly, overdischarge occurs, which leads to unevenness in charging and image defects.

SUMMARY

An object of the present invention is to provide an image forming apparatus that suppresses deterioration of image quality due to overdischarge and suppresses wastage of a photoreceptor when using a thick photoreceptor.

To achieve the abovementioned object, according to an aspect of the present invention, an image forming apparatus provided with a charging member to charge a surface of a photoreceptor, reflecting one aspect of the present invention comprises:

a power supply that applies to the charging member a first bias in which an AC voltage is superimposed on a DC voltage or a second bias which is a simple DC voltage; and a hardware processor that causes the power supply to apply the first bias until an amount used of the photoreceptor reaches a predetermined value, and causes the power supply to apply the second bias when the amount used of the photoreceptor reaches the predetermined value.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention:

FIGS. 9A to 9C are selection tables used in the bias selection process illustrated in FIG. 8.

DETAILED DESCRIPTION OF EMBODIMENTS

Hereinafter, one or more embodiments of the present invention will be described with reference to the drawings. In the following embodiment, various techniques are preferably limited in order to carry out the present invention. However, the scope of the invention is not limited to the disclosed embodiments and illustrative examples.

Figure 1:
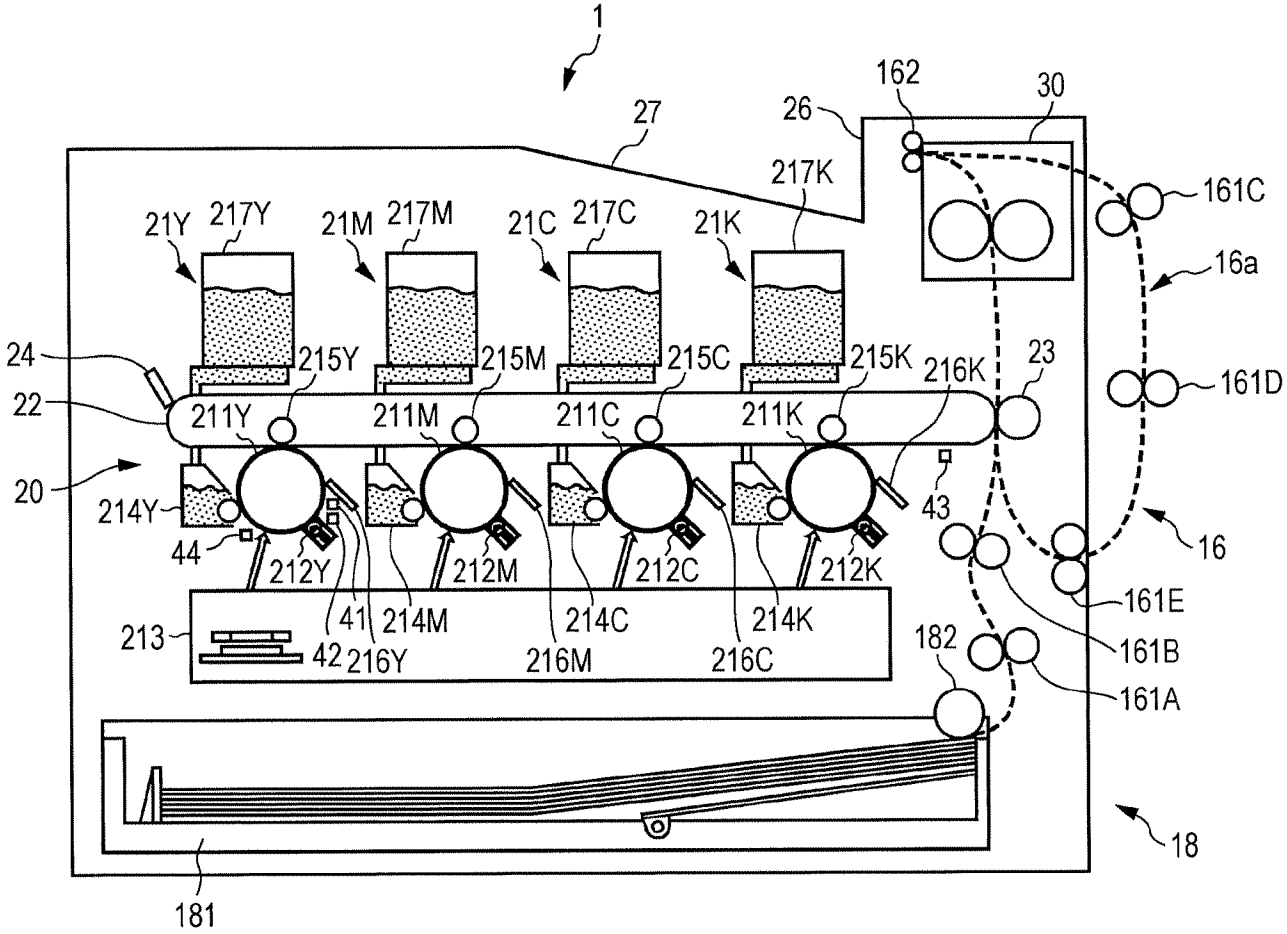
FIG. 1 is a schematic view illustrating an image forming apparatus according to an embodiment of the present invention.
Figure 2:
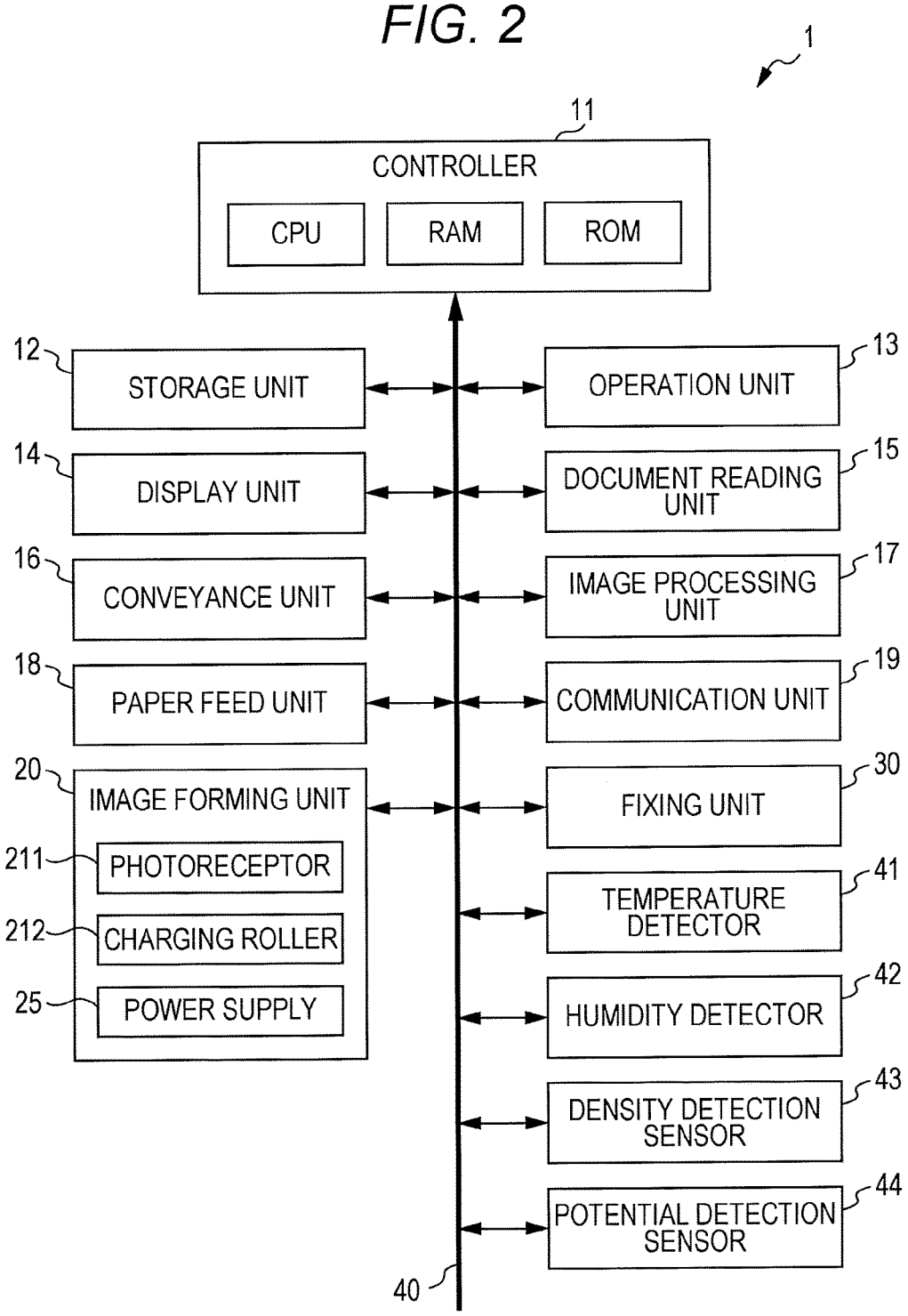
FIG. 2 is a block diagram illustrating a functional configuration of the image forming apparatus.

FIG. 1 is a view illustrating a schematic configuration of an image forming apparatus 1 according to the embodiment. FIG. 2 is a block diagram illustrating a functional configuration of the image forming apparatus 1.

The image forming apparatus 1 is, for example, a multi-function peripheral that forms an image on a sheet of paper. As illustrated in FIG. 1, the image forming apparatus 1 includes a conveyance unit 16, a paper feed unit 18, an image forming unit 20, a fixing unit 30, a temperature detector 41, a humidity detector 42, a density detection sensor 43, a potential detection sensor 44, and the like.

In accordance with an instruction from a controller 11, the image forming apparatus 1 reads a document set on a document table with a document reading unit 15 (see FIG. 2) of a scanner and the like provided for copying. The image forming apparatus 1 then generates an original image in bitmap format having color values of red (R), green (G), and blue (B) per pixel. The original image having the color values of R, G, and B generated by the document reading unit 15 is converted into an original image having color values of Y, M, C, and K by a color conversion unit (not illustrated), and then stored in a storage unit 12 (see FIG. 2).

The conveyance unit 16 includes a plurality of conveying rollers 161A, 161B, 161C, 161D, 161E, a paper output roller 162, and the like. In accordance with an instruction from the controller 11, the conveyance unit 16 conveys the sheet fed from the paper feed unit 18 or a manual feed tray (not illustrated) to the image forming unit 20 and the fixing unit 30. The conveyance unit 16 then ejects the sheet, on which an image is formed and fixed, to a paper output tray 27 from a paper outlet 26. The paper output tray 27 is where the ejected sheet is placed. The conveyance unit 16 includes a reversing unit 16*a* to reverse the sheet conveyed from the fixing unit 30 and to convey the sheet again to the image forming unit 20.

The paper feed unit 18 includes a plurality of paper feed trays 181. In accordance with an instruction from the controller 11, the paper feed unit 18 feeds a sheet to the image forming unit 20 with a paper feed roller 182. Each of the paper feed trays 181 contains sheets of a predetermined type and size.

In accordance with an instruction from the controller 11, the image forming unit 20 forms an image composed of a plurality of colors, that is, Y, M, C, and K on a sheet based on the original image subjected to image processing by the image processing unit 17 (see FIG. 2). The image forming unit 20 includes four writing units 21Y, 21M, 21C, and 21K, an intermediate transfer belt 22, a secondary transfer unit 23, a cleaning blade 24, a power supply 25 (see FIG. 2), and the like.

The four writing units 21Y, 21M, 21C, and 21K are arranged along a surface of the intermediate transfer belt 22, and form images of colors of Y, M, C, and K, respectively. The writing unit 21Y includes a photoreceptor 211Y, a charging roller (charging member) 212Y, an optical scanning device 213, a developing unit 214Y, a primary transfer roller 215Y, a cleaning unit 216Y, and a toner bottle 217Y. The photoreceptor 211Y is formed by laminating a photosensitive layer such as a charge generation layer and a charge transport layer on a conductive supporting body. In the present invention, a film thickness of the photoreceptor represents a thickness of the photosensitive layer. In order to prolong the life of the photoreceptor 211Y, the film thickness of the photosensitive layer is formed to be thicker than the thickness in the related art (for example, about 20 μm), that is, for example, about 35 μm.

At the time of forming an image, the writing unit 21Y applies a voltage to the photoreceptor 211Y with the charging roller 212Y to charge the photoreceptor 211Y. Then, the optical scanning device 213 scans the photoreceptor 211Y with luminous flux emitted based on the original image so as to form an electrostatic latent image. When a color material such as toner is supplied from the developing unit 214Y to develop the electrostatic latent image on the photoreceptor 211Y, a toner image is formed on the photoreceptor 211Y serving as an image carrier. When an amount of toner in the developing unit 214Y decreases, toner contained in the toner bottle 217Y is supplied to the developing unit 214Y. The toner bottle 217Y is a removable unit. When the toner in the toner bottle 217Y is completely consumed, the toner bottle 217Y is replaced with a new toner bottle 217Y by a user so that the toner is continuously supplied to the image forming apparatus 1.

Note that the writing units 21M, 21C, and 21K are similar to the writing unit 21Y in configuration so that description thereof will be omitted. Furthermore, each of the writing units 21Y, 21M, 21C, and 21K share the optical scanning device 213.

Hereinafter, the writing units 21Y to 21K, the photoreceptors 211Y to 211K, the charging rollers 212Y to 212K, the developing units 214Y to 214K, the primary transfer rollers 215Y to 215K, the cleaning units 216Y to 216K, the toner bottles 217Y to 217K will be simply referred to as the writing unit 21, the photoreceptor 211, the charging roller 212, the developing unit 214, the primary transfer roller 215, the cleaning unit 216, and the toner bottle 217, unless it is required to distinguish them from each other.

The intermediate transfer belt 22 is an endless belt-like image carrier wound and rotated by a plurality of rollers. The plurality of rollers includes the primary transfer rollers 215Y to 215K.

The secondary transfer unit 23 is disposed in a transport path of the sheet fed from the paper feed unit 18. The secondary transfer unit 23 transfers (secondarily transfers) the toner image on the intermediate transfer belt 22 onto the sheet fed from the paper feed unit 18, and conveys the sheet to the fixing unit 30.

The cleaning blade 24 is provided between the secondary transfer unit 23 and the writing units 21Y to 21K in a rotational direction of the endless intermediate transfer belt 22. The cleaning blade 24 is brought into contact with an outer surface of the intermediate transfer belt 22 so as to clean the outer surface. A material of the cleaning blade 24 is not specifically limited. Various resins, metals, and the like are employable in addition to elastic members such as polyurethane, silicone rubber, and fluoro-rubber, but the elastic members are preferable.

In accordance with an instruction from the controller 11, the power supply 25 applies a first bias or a second bias to the charging roller 212. In the first bias, an AC voltage is superimposed on a DC voltage, and the second bias is a simple DC voltage. The power supply 25 is capable of adjusting magnitude of the voltage of the first or second bias, and includes a circuit to detect a current value flowing in applying the first or second bias. The power supply 25 outputs the detected current value to the controller 11. Based on the current value, the controller 11 is able to detect the film thickness of the photoreceptor 211.

In accordance with an instruction from the controller 11, the fixing unit 30 thermally fixes an image on the sheet on which the toner image as an image of the color material is formed by the image forming unit 20. In other words, the fixing unit 30 heats and pressurizes the sheet on which the toner image is formed by the image forming unit 20. In a case of forming images on both sides of the sheet, the sheet on which an image has been fixed by the fixing unit 30 on one side is reversed by the reversing unit 16*a*, and the sheet is fed again to a position of the secondary transfer unit 23.

The temperature detector 41 is provided in the vicinity of the photoreceptor 211Y, and is configured to detect a temperature in the vicinity of the photoreceptor 211Y so as to output the detected temperature to the controller 11. The humidity detector 42 is provided in the vicinity of the photoreceptor 211Y, and is configured to detect humidity in the vicinity of the photoreceptor 211Y so as to output the detected humidity to the controller 11.

In the illustrated example, the temperature detector 41 and the humidity detector 42 are disposed in the vicinity of the photoreceptor 211Y because the photoreceptor 211Y is disposed furthest away from the fixing unit 30. However, the temperature detector 41 and the humidity detector 42 may be provided to any one of the photoreceptors 211M, 211C, and 211K, or may be provided to all of the photoreceptors 211Y to 211K.

The density detection sensor 43 is disposed downstream of each writing unit 21 and upstream of the secondary transfer unit 23 in the rotation direction of the intermediate transfer belt 22, facing the intermediate transfer belt 22. The density detection sensor 43 detects density of the toner image formed on the intermediate transfer belt 22. The density detection sensor 43 is a reflection type optical sensor which includes a light emitting element such as a light emitting diode (LED) and a light receiving element such as a photodiode (PD), and which detects reflection intensity of the toner image. The density detection sensor 43 may be a line type sensor.

The density detection sensor 43 outputs the detected density data to the controller 11. The controller 11 analyzes the detected density data and detects whether there is any density unevenness in the toner image. For example, when a difference between the maximum value and the minimum value of the density in the detected density data is equal to or more than a predetermined value, the controller 11 determines that there is density unevenness. In this manner, the density detection sensor 43 and the controller 11 herein function as a density-unevenness detector.

The potential detection sensor 44 is provided in the vicinity of the photoreceptor 211Y, and is configured to detect a surface potential of the photoreceptor 211Y. The potential detection sensor 44 outputs the detected surface potential to the controller 11. Based on the detected surface potential, the controller 11 detects whether there is potential unevenness in the electrostatic latent image. For example, when a difference between the maximum value and the minimum value of the potential in the detected surface potential is equal to or more than a predetermined value, the controller 11 determines that there is potential unevenness. In this manner, the potential detection sensor 44 and the controller 11 herein function as a potential-unevenness detector.

In the illustrated example, the potential detection sensor 44 is disposed in the vicinity of the photoreceptor 211Y. However, the potential detection sensor 44 may be provided to any one of the photoreceptors 211M, 211C, and 211K, or may be provided to all of the photoreceptors 211Y to 211K.

As illustrated in FIG. 2, the image forming apparatus 1 includes the controller 11, the storage unit 12, an operation unit 13, a display unit 14, the document reading unit 15, the conveyance unit 16, the image processing unit 17, the paper feed unit 18, a communication unit 19, the image forming unit 20, the fixing unit 30, the temperature detector 41, the humidity detector 42, the density detection sensor 43, the potential detection sensor 44, and the like. Each unit in the image forming apparatus 1 is connected through a bus 40.

The controller 11 includes a central processing unit (CPU), a random access memory (RAM), a read only memory (ROM), and the like, and controls each unit in the image forming apparatus 1. The ROM is a storage unit in which various programs and various data are stored. In the controller 11, the CPU reads the various programs from the ROM so as to develop the programs in the RAM as appropriate, and then executes various processes in cooperation with the developed programs and the CPU. For example, the controller 11 causes the image processing unit 17 to execute image processing on an original image in bitmap format generated by the document reading unit 15 or received through the communication unit 19 and held in the storage unit 12. Then the controller 11 causes the image forming unit 20 to form an image on a sheet based on original image data after the image processing.

Furthermore, the controller 11 herein functions as a speed adjuster that adjusts printing speed in the image forming apparatus 1. The controller 11 adjusts the printing speed based on an operation by the user. In accordance with the printing speed, the controller 11 controls sheet conveying speed of the conveyance unit 16, rotating speed and the like of the photoreceptor 211 and the intermediate transfer belt 22.

Still further, the controller 11 functions as a print mode selector that selects a print mode (print quality) in executing a job. Examples of the print mode include a character mode to output an image composed of binary images such as characters and drawings, and a photo mode to output a multiple-valued image with halftone density such as a photograph. The print mode may be selected by the controller 11 based on an operation by the user, or may be selected by the controller 11 in accordance with input image data.

The storage unit 12 includes a dynamic random access memory (DRAM) and the like, serving as an image memory that temporarily stores various data such as image data related to various image processing. The storage unit 12 may be configured to include a hard disk drive (HDD) and the like, and may writably and readably store various data.

The operation unit 13 and the display unit 14 are provided to the image forming apparatus 1 as user interfaces. The operation unit 13 generates an operation signal according to an operation of the user, and outputs the operation signal to the controller 11. Examples of the operation unit 13 include a keypad, and a touch panel integrated with the display unit 14. The display unit 14 displays an operation screen and the like in accordance with an instruction from the controller 11. Examples of the display unit 14 include a liquid crystal display (LCD), and an organic electro luminescence display (OELD).

The image processing unit 17 executes required image processing on image data stored in the storage unit 12, image data obtained by reading an image from a document with the document reading unit 15, and image data input from an external device through the communication unit 19. The image processing unit 17 then outputs the image data after the image processing to the image forming unit 20. The image processing includes gradation processing, halftone processing, color conversion processing, and the like. In the gradation processing, a gradation value of each pixel of the image data is converted into a gradation value which is corrected so as to match density characteristics of the image formed on the sheet with target density characteristics. The halftone processing includes error diffusion processing, screen processing using a systematic dither method, and the like. In the color conversion processing, each gradation value of RGB is converted into each gradation value of YMCK.

The communication unit 19 includes a network card and the like, and is connected to a network such as a local area network (LAN). The communication unit 19 communicates with an external device on the network, for example, a user terminal such as a personal computer (PC), and a server. The communication unit 19 receives image data for forming an image from the external device over the network.

In the image forming apparatus 1 configured as described above, when printing is instructed, the sheets contained in the paper feed tray 181 are taken out one by one by the paper feed roller 182 and conveyed by the conveying rollers 161A and 161B. Simultaneously with paper feeding, the charging rollers 212Y to 212K charge surfaces of the photoreceptors 211Y to 211K, and then the optical scanning device 213 exposes the photoreceptors 211Y to 211K to light based on the image data so that an electrostatic latent image is formed. This electrostatic latent image is developed by the developing units 214Y to 214K of each color, and a toner image is formed on each of the photoreceptors 211Y to 211K. These toner images are transferred onto the intermediate transfer belt 22 by a transfer bias applied to the primary transfer rollers 215Y to 215K. Residual toner on a photosensitive drum is removed by the cleaning units 216Y to 216K. The toner images on the intermediate transfer belt 22 are transferred onto the conveyed sheet by a secondary transfer bias applied to the secondary transfer unit 23. Residual toner on the intermediate transfer belt 22 is removed by the cleaning blade 24. Passing through the fixing unit 30, the toner images formed on the sheet are heated and pressurized so as to be fixed on the sheet, and an image is formed on the sheet. The sheet with the image is ejected to the paper output tray 27 by the paper output roller 162.

In a case of forming images on both sides of the sheet, the paper output roller 162 is rotated in a reverse direction after the sheet passes through the fixing unit 30 so that the sheet is conveyed again to the secondary transfer unit 23 by the conveying rollers 161C to 161E. After carrying out the secondary transfer and fixing, the sheet is ejected to the paper output tray 27 by the paper output roller 162.

Figure 3:
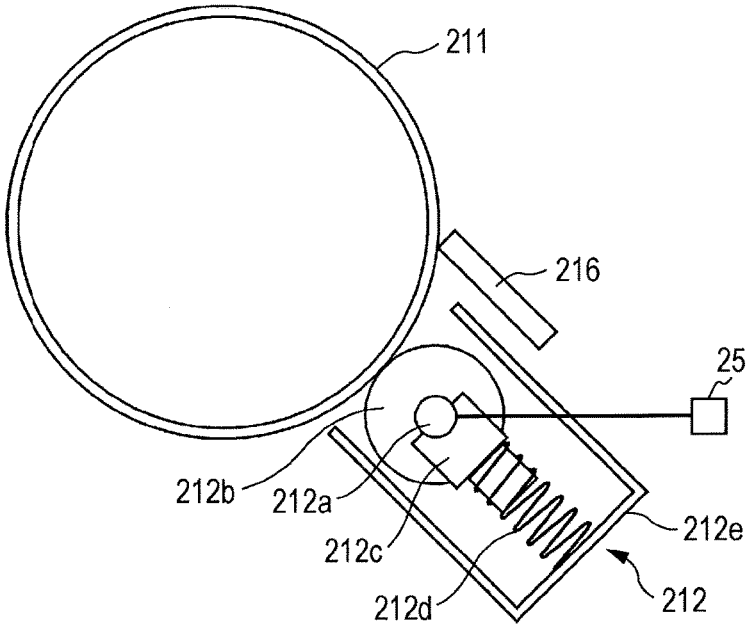
FIG. 3 is a schematic view illustrating a charging roller and peripheral members thereof.

Hereinafter, the charging roller 212 will be described with reference to FIG. 3. FIG. 3 is a schematic view illustrating a configuration of the charging roller 212 and peripheral members thereof.

As illustrated in FIG. 3, the charging roller 212 includes a conductive shaft 212*a* such as a metal to which the first bias or the second bias is applied from the power supply 25; a conductive elastic layer 212*b* provided to the outer periphery of the conductive shaft 212*a*, including conductive rubber and the like; a holding member 212*c* to hold the conductive shaft 212*a*; an elastic member 212*d* such as a spring to bias the conductive shaft 212*a* in a direction approaching the photoreceptor 211; and a housing 212*e* fixed to a predetermined position, covering these members.

One end of the elastic member 212*d* is fixed to an interior of the housing 212*e*, and the other end is fixed to the holding member 212*c*. Accordingly, the conductive shaft 212*a* is biased in the direction approaching the photoreceptor 211, and the conductive elastic layer 212*b* comes into contact with the outer periphery of the photoreceptor 211. Driven by the rotation of the photoreceptor 211, the conductive shaft 212*a* and the conductive elastic layer 212*b* rotate.

When a voltage is applied to the conductive shaft 212*a* by the power supply 25, proximate discharge occurs in a space near a contact portion between the photoreceptor 211 and the conductive elastic layer 212*b* so that the surface of the photoreceptor 211 is imparted with an electric charge, which causes charging of the surface of the photoreceptor 211.

Figure 4:
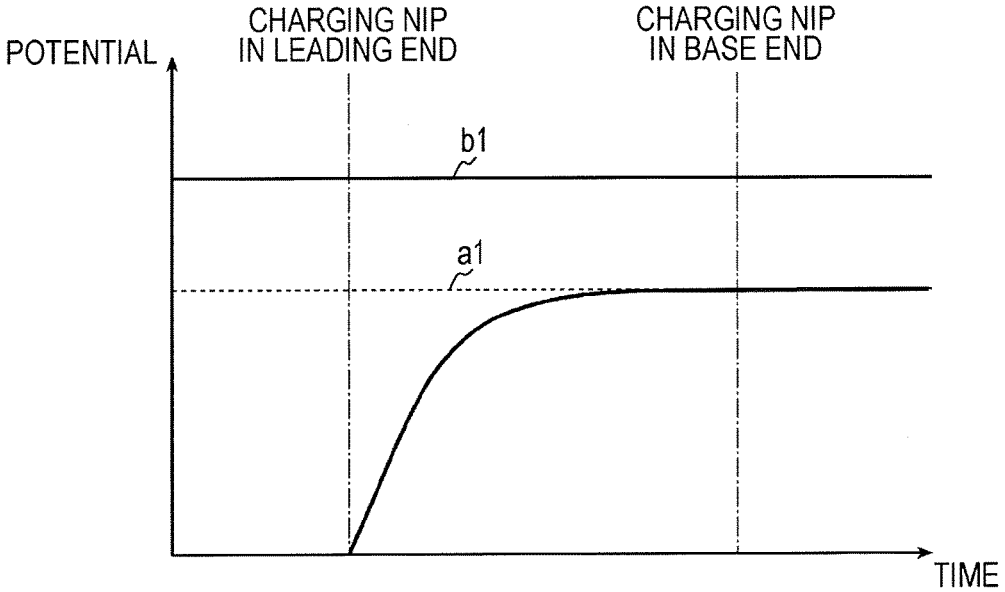
FIG. 4 is a graph illustrating transition of a surface potential of a photoreceptor when a second bias is applied.
Figure 5:
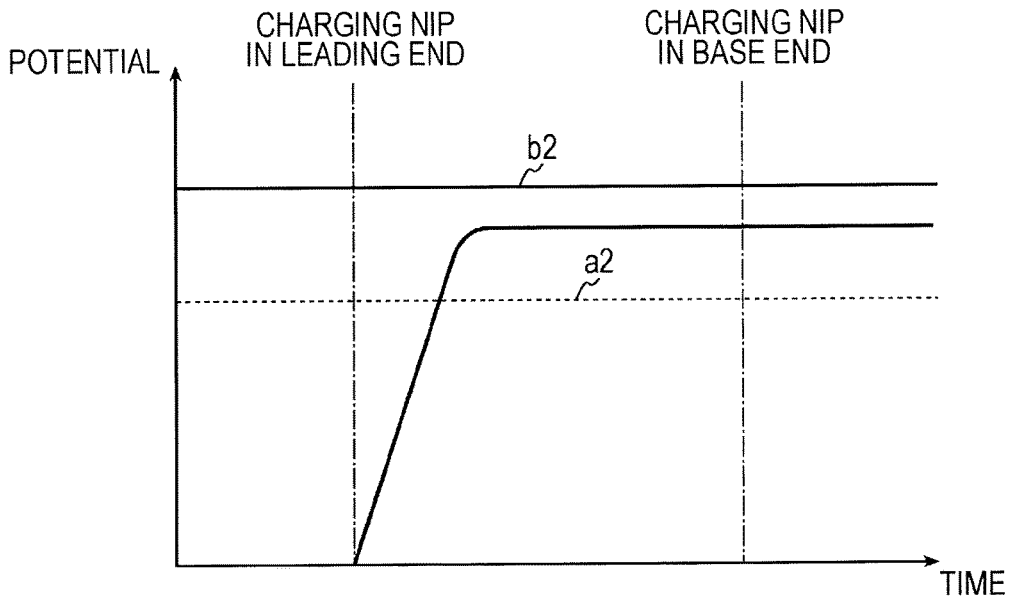
FIG. 5 is a graph illustrating transition of the surface potential of the photoreceptor when the second bias is applied under conditions disadvantageous for charging.
Figure 6:
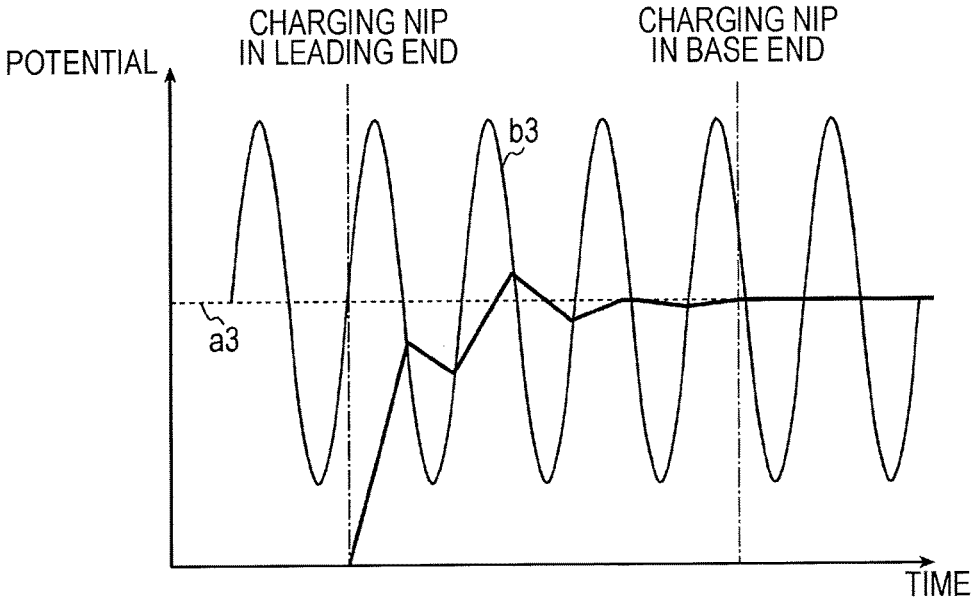
FIG. 6 is a graph illustrating transition of the surface potential of the photoreceptor when a first bias is applied.

Referring to FIGS. 4 to 6, hereinafter described is a state of the photoreceptor 211 when the first or second bias is applied to the charging roller 212 configured as described above. In FIGS. 4 to 6, a position at which the rotating photoreceptor 211 approaches the charging roller 212 to start discharging is referred to as a "charging nip in a leading end", and a position at which the photoreceptor 211 is separated from the charging roller 212 to stop discharging is referred to as a "charging nip in a base end".

FIG. 4 illustrates transition of a photoreceptor surface potential when the photoreceptor 211 is charged by the second bias.

A second bias b1 is applied to the charging roller 212. The second bias b1 is a value in which a discharge starting voltage obtained from Paschen's law is added to a target value a1 of the photoreceptor surface potential. When the photoreceptor 211 passes the charging nip in the leading end, discharge occurs between the photoreceptor 211 and the charging roller 212, which leads to an increase in the photoreceptor surface potential. The increase in the photoreceptor surface potential decreases a difference between the second bias b1 and the photoreceptor surface potential, which reduces the discharge and moderates the rise of the photoreceptor surface potential. When the photoreceptor surface potential increases up to the target value a1, the difference between the second bias b1 and the photoreceptor surface potential becomes smaller than the discharge starting voltage so that the discharge stops and the photoreceptor surface potential does not increase further.

As described above, when the photoreceptor 211 is charged by the second bias under conditions disadvantageous to charge the photoreceptor 211 such as a case where the printing speed is high or a case where the film thickness of the photoreceptor 211 is thick, it is required to set an applied voltage to a high value.

FIG. 5 illustrates transition of the photoreceptor surface potential when the photoreceptor 211 is charged by the second bias under such conditions disadvantageous for charging.

A second bias b2 is applied to the charging roller 212. The second bias b2 is a value in which a discharge starting voltage obtained from Paschen's law is added to a target value a2 of the photoreceptor surface potential. The second bias b2 is set to a higher voltage than the second bias b1 in FIG. 4. Application of such a high voltage causes a large number of electric charges to be injected into the charging roller 212, and when the photoreceptor 211 passes the charging nip in the leading end, the accumulated electric charges are excessively discharged, which increases the photoreceptor surface potential more than requires. Accordingly, the photoreceptor surface potential exceeds the target value a2. When a difference between the second bias b2 and the photoreceptor surface potential becomes smaller than the discharge starting voltage, the discharge stops and the photoreceptor surface potential does not increase further. However, the photoreceptor surface potential is charged to a potential higher than the target value a2. Such excessive charging occurs at a plurality of places in the charging roller 212. In those places with excessive charging, density of an image to be formed becomes thin.

FIG. 6 illustrates transfer of the photoreceptor surface potential when the photoreceptor 211 is charged by the first bias.

A target value a3 of the photoreceptor surface potential is set to an intermediate value and a first bias b3 is applied to the charging roller 212. The first bias b3 has a width exceeding a discharge starting voltage obtained from Paschen's law. After the photoreceptor 211 passing the charging nip in the leading end, application of a voltage to a side to be charged in the photoreceptor 211 increases the photoreceptor surface potential, and application of a voltage to a side to be eliminated in the photoreceptor 211 decreases the photoreceptor surface potential. Repetition of charging and elimination of the photoreceptor 211 causes the photoreceptor surface potential to gradually approach the target value a3. In a case where the first bias is set to a high voltage, even when a large amount of electric charge is injected into the charging roller 212 and the photoreceptor surface potential exceeds the target value a3, a voltage is applied to the side to be eliminated in the photoreceptor 211 so that the photoreceptor surface potential decreases and approaches the target value a3. Therefore, after the photoreceptor 211 passing through the charging nip, the photoreceptor surface potential matches the target value a3.

Herein, the cleaning unit 216 presses a cleaning blade including a rubber material such as urethane rubber against the photoreceptor 211 so as to remove residual toner. The toner and an external additive contained in the toner are blocked at a contact portion between the photoreceptor 211 and the cleaning unit 216. This blockage puts a load on the photoreceptor 211 so that the surface of the photoreceptor 211 is cut, whereby cleaning is performed. When the film thickness of the photoreceptor 211 becomes thinner due to repetitive cleaning, a function to hold the potential deteriorates and noise is generated in an image. Therefore, when the film thickness of the photoreceptor 211 reaches a predetermined value, it is required to replace the photoreceptor 211 or units including the photoreceptor 211. As illustrated in FIGS. 4 to 6, when the film thickness of the photoreceptor 211 is thick, application of the first bias to the charging roller 212 is less likely to cause overdischarge and image defects. However, an amount of decrease in the film thickness of the photoreceptor 211 due to the cleaning is larger in a case of applying the first bias than in a case of applying the second bias.

Therefore, in the present embodiment, the controller 11 is configured to cause the power supply 25 to apply the first bias until an amount used of the photoreceptor 211 reaches a predetermined value. Furthermore, the controller 11 is configured to cause the power supply 25 to apply the second bias when the amount used of the photoreceptor 211 reaches the predetermined value. As the first bias is applied until the amount used of the photoreceptor 211 reaches the predetermined value, that is, when the film thickness of the photoreceptor 211 is thick, it is possible to suppress image defects due to overdischarge. As the second bias is applied after the amount used of the photoreceptor 211 reaches the predetermined value, that is, when the film thickness of the photoreceptor 211 is thin, it is possible to suppress wastage of the photoreceptor 211.

Specifically, for example, the controller 11 determines whether the amount used of the photoreceptor 211 has reached the predetermined value based on the film thickness of the photoreceptor 211. In other words, when the film thickness of the photoreceptor 211 is equal to or more than a predetermined value, the amount used of the photoreceptor 211 is determined not to have reached the predetermined value, and when the film thickness of the photoreceptor 211 is less than the predetermined value, the amount used of the photoreceptor 211 is determined to have reached the predetermined value.

The controller 11 configured in such manners performs, for example, first to third bias selection processes and the like as illustrated in FIGS. 7 to 10. It should be noted that the controller 11 may perform any one of the first to third bias selection processes, or may select one of the first to third bias selection processes based on an operation by the user. Furthermore, the first to third bias selection processes are all examples of a bias selection process, and the present invention is not limited thereto.

Figure 7:
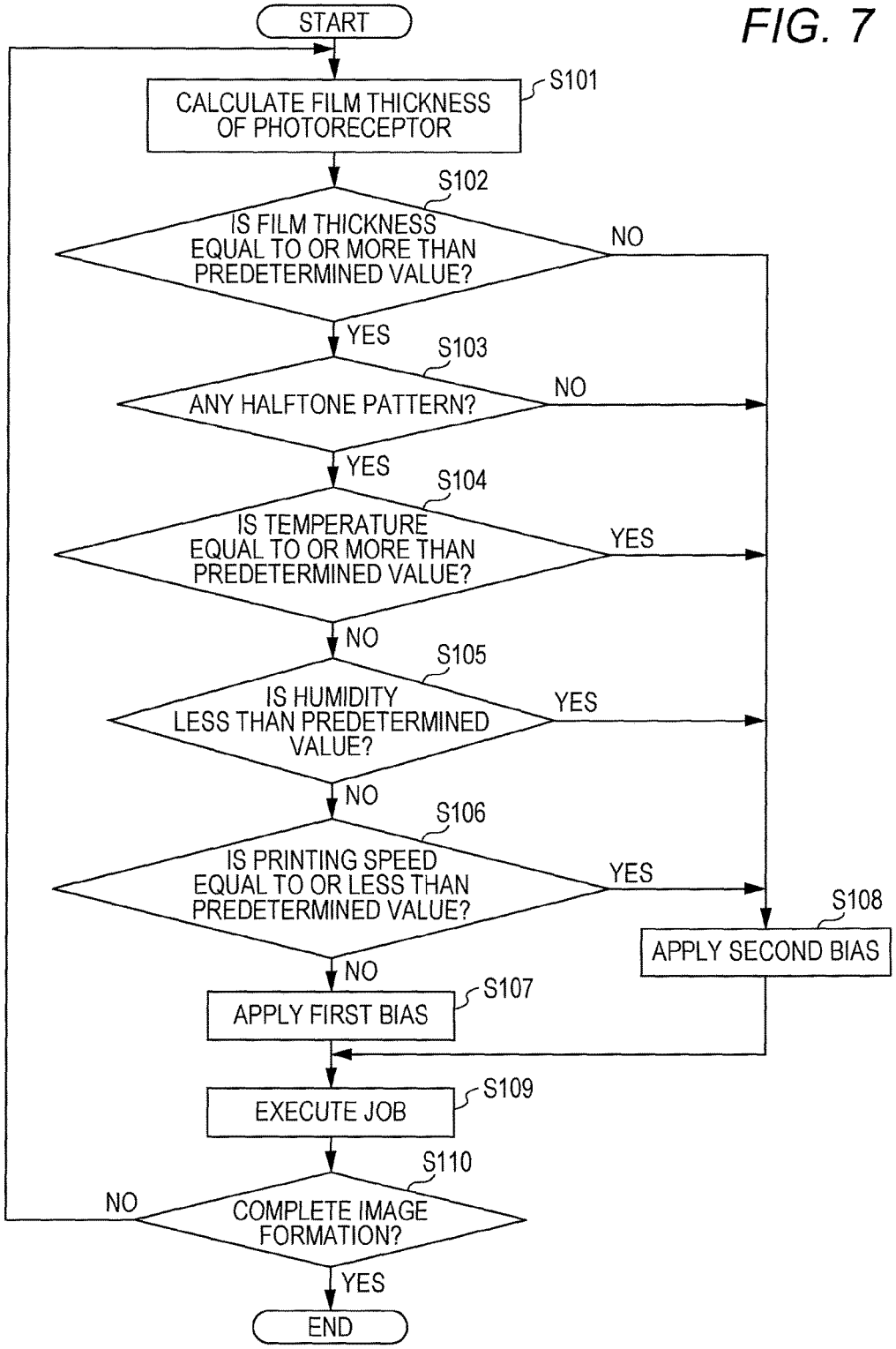
FIG. 7 is a flowchart illustrating an example of a bias selection process.

The first bias selection process performed by the controller 11 will hereinafter be described with reference to FIG. 7. FIG. 7 is a flowchart illustrating the first bias selection process. Prior to executing an input job, the controller 11 performs the first bias selection process illustrated in FIG. 7.

First, the controller 11 calculates the film thickness of the photoreceptor 211 (step S101).

Specifically, for example, each time the controller 11 executes the job, the controller 11 calculates the following information and stores in the storage unit 12, that is: an integration of time when the first bias is applied (first bias application time); an integration of time when the second bias is applied (second bias application time); an average value of a coverage of an image formed by applying the first bias (average coverage in applying the first bias); an average value of a coverage of an image formed by applying the second bias (average coverage in applying the second bias). The controller 11 acquires these pieces of information from the storage unit 12 in step S101, and calculates the film thickness of the photoreceptor, for example, by the following formula (1). In this manner, the controller 11 functions as a film thickness detector.

film thickness of photoreceptor=initial film thickness−(second bias application time ($h$)×average coverage in applying the second bias (%)×coefficient $A$)−(first bias application time ($h$)×average coverage in applying the first bias (%)×coefficient $B$) Formula (1):

The initial film thickness indicates a film thickness when the photoreceptor 211 is used for the first time or a film thickness of the photoreceptor 211 right after replacement when the photoreceptor 211 is exchanged due to deterioration. The coefficient A is an amount by which the film of the photoreceptor 211 is cut off when applying the second bias and forming an image of 1% coverage for consecutive one hour. The coefficient B is an amount by which the film of photoreceptor 211 is cut off when applying the first bias and forming an image of 1% coverage for consecutive one hour. Therefore, coefficient A< coefficient B is obtained.

With a high coverage of an image to be formed, the photoreceptor 211 is supplied with a large amount of toner and a large amount of external additive contained in the toner, which tends to increase the wastage of the photoreceptor 211. The Formula (1) is an equation assuming that the wastage of the photoreceptor 211 is doubled when the average coverage is doubled. It is required that a correlation between the average coverage and the wastage of the photoreceptor 211 is matched with an actual correlation. Therefore, the correlation may be corrected using a table and the like of the coverage and the wastage. In addition, when the wastage varies depending on the temperature and humidity inside the image forming apparatus 1 and on the printing speed, the correlation may be additionally corrected based on these conditions.

Next, the controller 11 determines whether the calculated film thickness of the photoreceptor 211 is equal to or more than the predetermined value (step S102).

When the film thickness of the photoreceptor 211 is determined not be equal to or more than the predetermined value (step S102; NO), the controller 11 determines that the amount used of the photoreceptor 211 has reached the predetermined value and causes the power supply 25 to apply the second bias (step S108). In this case, the film thickness of the photoreceptor 211 is sufficiently thin so that overdischarge hardly occurs even with application of the second bias. Accordingly, it is possible to reduce the wastage of the photoreceptor 211.

When the film thickness of the photoreceptor 211 is determined to be equal to or more than the predetermined value (step S102; YES), the controller 11 determines that the amount used of the photoreceptor 211 has not reached the predetermined value. Then, the controller 11 determines whether there is any halftone pattern in input image data (step S103). Specifically, for example, the controller 11 determines the presence or absence of a halftone pattern on the basis of data indicating an attribute of an image previously attached to the input image data. Herein, the halftone pattern refers to a region with a halftone density within a predetermined range in which a density gradation value is near 128, where the density gradation value of each pixel is represented by 0 to 255. For example, the presence or absence of a halftone pattern may be determined based on a coverage of the input image data, and it may be determined that there is a halftone pattern when the coverage is equal to or more than a predetermined value.

When it is determined that there is no halftone pattern (step S103; NO), the controller 11 causes the power supply 25 to apply the second bias (step S108). Herein, in printing an image with a halftone pattern, image defect occurs due to overdischarge between the photoreceptor 211 and the charging roller 212. However, in printing an image with no halftone pattern, for example, an image composed of binary images such as characters and drawings, an image defect does not occur even though overdischarge occurs. This is because a high gradation portion in the image is exposed by the optical scanning device 213 and a potential is sufficiently lowered so that a low gradation portion is not exposed, which hardly causes image defects even though overdischarge occurs in the photoreceptor 211. Even with overdischarge, an image defect does not occur, so that application of the second bias can lead to reduction in the wastage of the photoreceptor 211.

When it is determined that there is a halftone pattern (step S103; YES), the controller 11 determines whether the temperature inside the apparatus detected by the temperature detector 41 is equal to or more than a predetermined value (step S104). When the temperature is determined to be equal to or more than the predetermined value (step S104; YES), the controller 11 causes the power supply 25 to apply the second bias (step S108). The temperature inside the apparatus being equal to or more than the predetermined value is a condition advantageous to charge the photoreceptor 211. Therefore, it is not required to set the applied voltage to a high value, and even with application of the second bias, overdischarge hardly occurs. Accordingly, application of the second bias can reduce the wastage of the photoreceptor 211.

When the temperature inside the apparatus is determined not to be equal to or more than the predetermined value (step S104; NO), the controller 11 determines whether the humidity in the apparatus detected by the humidity detector 42 is less than a predetermined value (Step S105). When the humidity is determined to be less than the predetermined value (step S105; YES), the controller 11 causes the power supply 25 to apply the second bias (step S108). The humidity in the apparatus being less than the predetermined value is a condition advantageous to charge the photoreceptor 211. Therefore, it is not required to set the applied voltage to a high value, and even with application of the second bias, overdischarge hardly occurs. Accordingly, application of the second bias can reduce the wastage of the photoreceptor 211.

When the humidity in the apparatus is determined not to be less than the predetermined value (step S105; NO), the controller 11 determines whether the printing speed is equal to or less than a predetermined value (step S106). Whether the printing speed is equal to or less than the predetermined value is determined based on printing speed preset for a job to be input. When the printing speed is determined to be equal to or less than the predetermined value (step S106; YES), the controller 11 causes the power supply 25 to apply the second bias (step S108). The printing speed being equal to or less than the predetermined value is a condition advantageous to charge the photoreceptor 211. Therefore, it is not required to set the applied voltage to a high value, and even with application of the second bias, overdischarge hardly occurs. Accordingly, application of the second bias can reduce the wastage of the photoreceptor 211.

When the printing speed is determined not to be equal to or less than the predetermined value (step S106; NO), the controller 11 causes the power supply 25 to apply the first bias (step S107). In this case, the film thickness of the photoreceptor 211 is equal to or more than the predetermined value, the halftone pattern is included, the temperature inside the apparatus is lower than the predetermined value, the humidity in the apparatus is equal to or more than the predetermined value, and the printing speed is higher than the predetermined value. Therefore, application of the second bias easily causes overdischarge. Thus, with application of the first bias, it is possible to uniformly charge the photoreceptor 211 without causing overdischarge, and it is possible to suppress deterioration of image quality.

Next, the controller 11 causes the power supply 25 to apply the first bias or the second bias so as to execute the job (step S109).

Next, the controller 11 determines whether image formation is to be completed (step S110). When it is determined that the image formation is not to be completed (step S110; NO), the controller 11 repeats the process in step S101 and selects which one of the first bias and the second bias is to be applied to the next job select. On the other hand, when it is determined that the image formation is to be completed (step S110; YES), the controller 11 turns off the power supply 25 and ends the first bias selection process.

In such manners, the controller 11 performs the first bias selection process illustrated in FIG. 7.

In the processing of step S101, the controller 11 calculates the film thickness of the photoreceptor 211 based on the integration of time when the first bias is applied, the integration of time when the second bias is applied, and the coverage of the formed image. However, the present invention is not limited to this procedure. For example, the controller 11 may store the following conditions in the storage unit 12, that is, integrating drive time of the photoreceptor 211, the number of rotations of the photoreceptor 211, the number of integrating sheets printed by the image forming apparatus 1. Then, the controller 11 may calculate the film thickness of the photoreceptor 211 based on at least one of these conditions. Alternatively, the film thickness of the photoreceptor 211 may be calculated by adding the coverage of the formed image to these conditions. Alternatively, for example, the power supply 25 may output to the controller 11 the current value detected when applying a voltage, and the controller 11 may calculate the film thickness of the photoreceptor 211 based on the detected current value. In this case, the controller 11 and the power supply 25 function as a film thickness detector.

When the film thickness of the photoreceptor 211 is determined not to be equal to or more than the predetermined value in the processing of step S102 (step S102; NO), the amount used of the photoreceptor 211 is determined to have reached the predetermined value, and the process moves on to step S108. However, the present invention is not limited to this procedure.

For example, after the film thickness of the photoreceptor 211 is determined not to be equal to or more than the predetermined value (step S102; NO), the controller 11 may determine whether the temperature inside the apparatus is less than the predetermined value. In this case, when the temperature inside the apparatus is determined to be less than the predetermined value, the first bias may be applied instead of the second bias since it is required to set the applied voltage to a high value. Furthermore, for example, after the film thickness of the photoreceptor 211 is determined not to be equal to or more than the predetermined value (step S102; NO), the controller 11 may determine whether the humidity in the apparatus is equal to or more than a predetermined value. In this case, when the humidity in the apparatus is determined to be equal to or more than the predetermined value, the first bias may be applied instead of the second bias since it is required to set the applied voltage to a high value.

When the film thickness of the photoreceptor 211 is determined to be equal to or more than the predetermined value in step S102 (step S102; YES), the process moves on to steps S103 to S106. However, the present invention is not limited to this procedure.

For example, after the film thickness of the photoreceptor 211 is determined to be equal to or more than the predetermined value (step S102; YES), the controller 11 may perform the process in step S107.

In the processing of step S103, the controller 11 determines the presence or absence of a halftone pattern on the basis of the data indicating the attribute of the image previously attached to the input image data. However, the present invention is not limited to this procedure. For example, the controller 11 functioning as a print mode selector may determine whether the selected print mode is the photo mode or the character mode. In this case, when the print mode is determined to be the photo mode, the process moves on to step S104, and when the print mode is determined to be the character mode, the process moves on to step S108.

Figure 8:
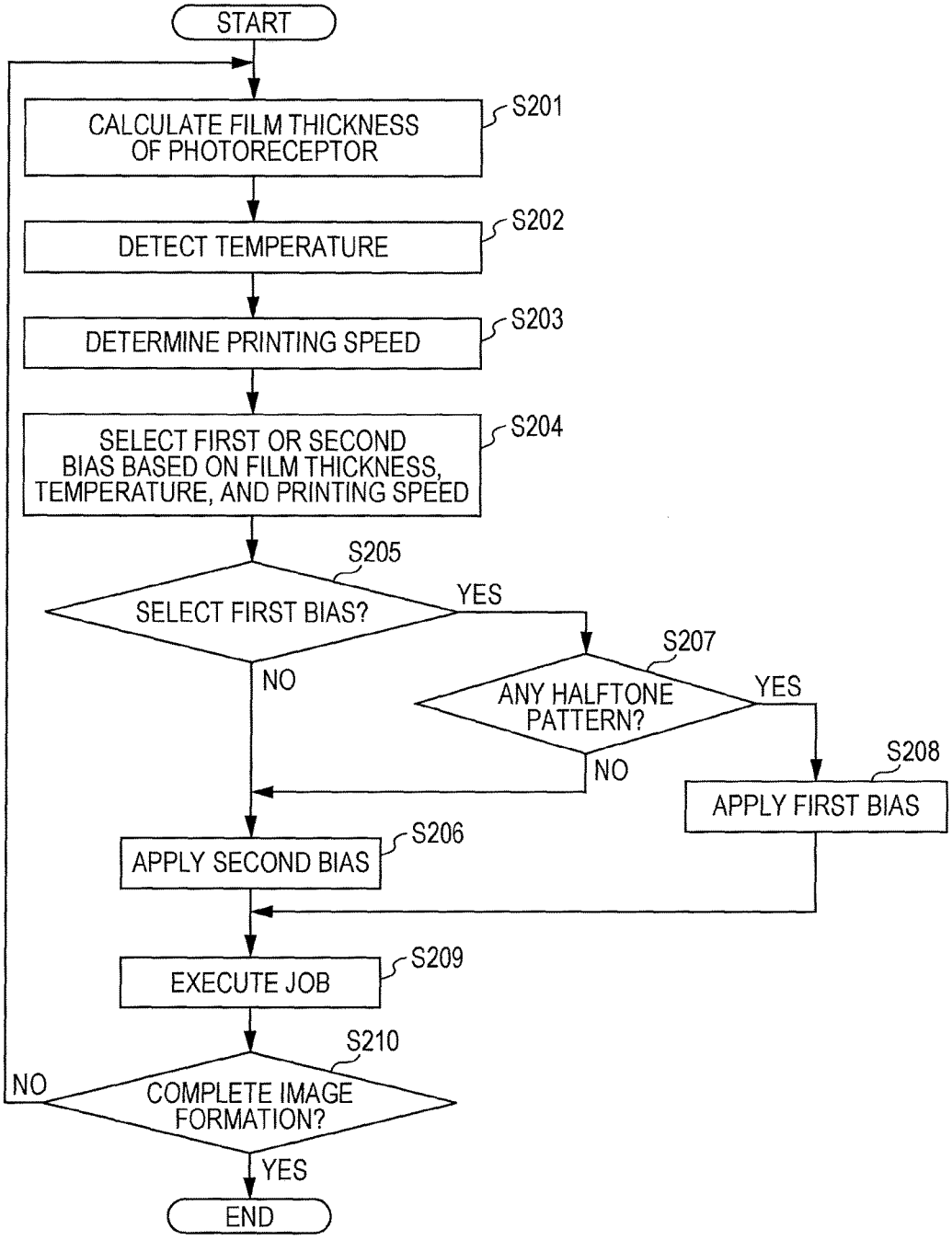
FIG. 8 is a flowchart illustrating an example of the bias selection process.

Subsequently, the controller 11 may perform the second bias selection process as illustrated in FIG. 8. FIG. 8 is a flowchart illustrating the second bias selection process. FIGS. 9A to 9C are selection tables used in the second bias selection process illustrated in FIG. 8. FIG. 9A is used when the film thickness of the photoreceptor 211 is equal to or more than 30 μm, FIG. 9B is used when the film thickness of the photoreceptor 211 is equal to or more than 20 μm and less than 30 μm, and FIG. 9C is used when the film thickness of the photoreceptor 211 is less than 20 μm.

Prior to executing an input job, the controller 11 performs the second bias selection process illustrated in FIG. 8.

In the second bias selection process illustrated in FIG. 8, each processing in steps S201, S207, S209, and S210 is similar to the processing in steps S101, S103, S109, and S110 of the first bias selection process illustrated in FIG. 7 so that description thereof will be omitted.

After calculating the film thickness of the photoreceptor 211 in step S201, the controller 11 detects the temperature inside the apparatus with the temperature detector 41 (step S202). Then, the controller 11 determines the printing speed according to the input job (Step S203).

Next, the controller 11 selects the first or second bias based on the film thickness of the photoreceptor 211, the temperature inside the apparatus, and the printing speed acquired in steps S201 to S203 (step S204). Specifically, the controller 11 selects the first bias or the second bias to be applied by the power supply 25 based on a preset selection table illustrated in FIGS. 9A to 9C.

Herein, setting a high applied voltage when applying the second bias easily causes overdischarge due to an increased accumulation of electric charges in the charging roller 212. When the film thickness of the photoreceptor 211 is thick, or when the temperature inside the apparatus is low, or when the printing speed is high, it is required to set the applied voltage high, which easily causes overdischarge. Accordingly, as illustrated in FIGS. 9A to 9C, the selection table is set in such a manner that the first bias is to be selected as the film thickness of the photoreceptor 211 becomes thicker, as the temperature inside the apparatus becomes lower, and as the printing speed becomes faster. For example, as illustrated in FIG. 9A, even when the photoreceptor 211 is brand-new (film thickness, 30 μm or more), that is, when the film thickness is thick, if the temperature inside the apparatus is high, the second bias is selected. For example, as illustrated in FIG. 9C, even when the photoreceptor 211 is used for a long time (film thickness, 20 μm or less), that is, when the film thickness is thin, if the temperature inside the apparatus is low, the first bias is selected.

In the examples illustrated in FIGS. 9A to 9C, the film thickness of the photoreceptor 211, the temperature, and the printing speed are employed as the conditions for selecting the first bias or the second bias. However, the humidity, for example, may be added to these conditions. In this case, when the humidity is high, the applied voltage is required to be set high. Therefore, it is preferable that the selection table is set in such a manner that the first bias is to be selected as the humidity becomes higher.

Next, the controller 11 determines whether the first bias is selected in step S204 (step S205). When the first bias is not selected, that is, when it is determined that the second bias is selected (step S205; NO), the controller 11 causes the power supply 25 to apply the second bias (step S206).

When it is determined that the first bias is selected (step S205; YES), the controller 11 determines whether there is a halftone pattern (step S207). When it is determined that there is a halftone pattern (step S207; YES), the controller 11 causes the power supply 25 to apply the first bias (step S208). When it is determined that there is no halftone pattern (step S207; NO), the controller 11 causes the power supply 25 to apply the second bias (step S207).

In such manners, the controller 11 performs the second bias selection process illustrated in FIG. 8.

Figure 10:
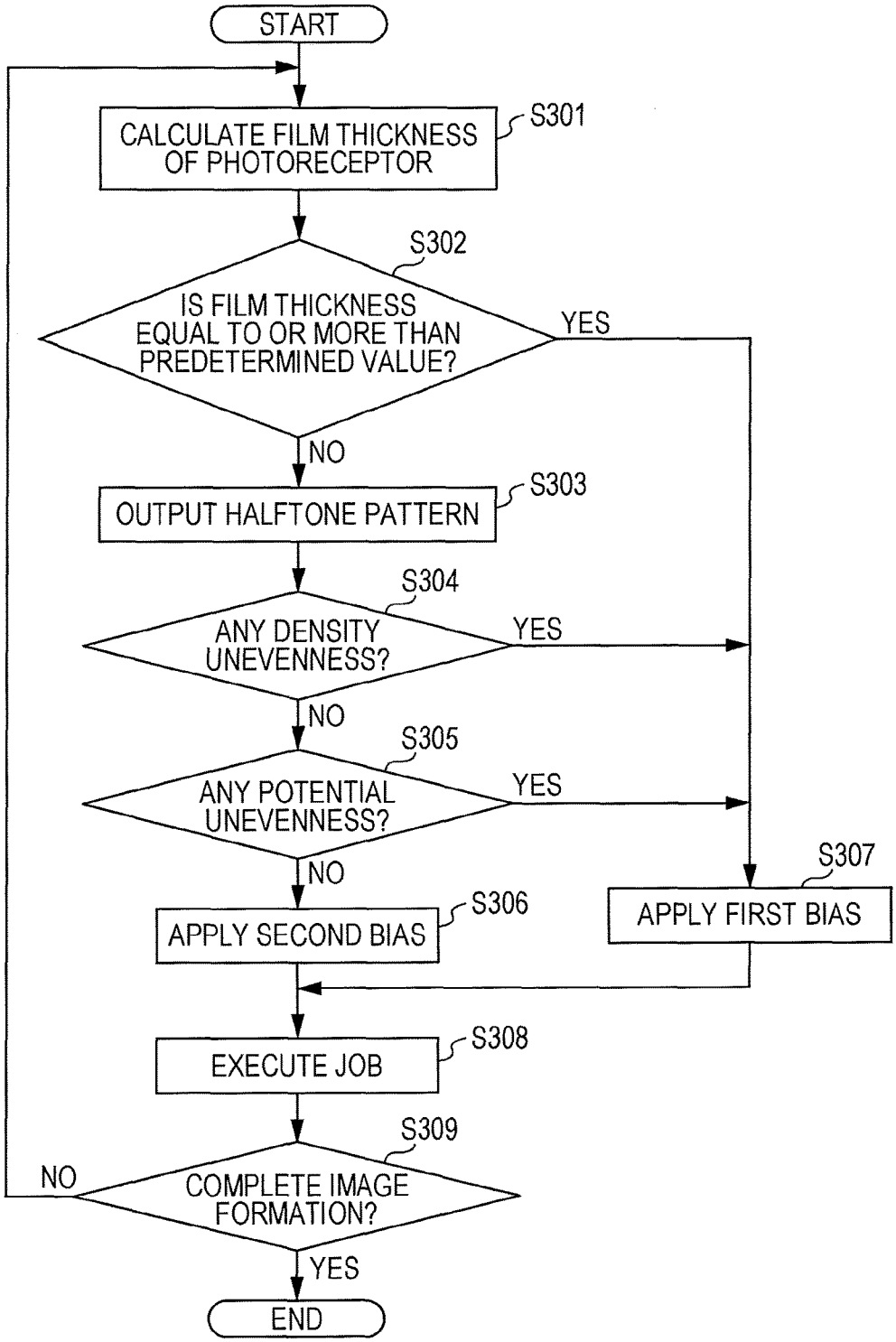
FIG. 10 is a flowchart illustrating an example of the bias selection process.

Subsequently, the third bias selection process performed by the controller 11 will be described with reference to FIG. 10. FIG. 10 is a flowchart illustrating the third bias selection process. Prior to executing an input job, the controller 11 performs the third bias selection process illustrated in FIG. 10.

In the third bias selection process illustrated in FIG. 10, each processing in steps S301, S302, S308, and S309 is similar to the processing in steps S101, S102, S109, and S110 of the first bias selection process illustrated in FIG. 7 so that description thereof will be omitted.

When the calculated film thickness of the photoreceptor 211 is determined to be equal to or more than the predetermined value (step S302; YES), the controller 11 causes the power supply 25 to apply the first bias (step S307). On the other hand, when the calculated film thickness of the photoreceptor 211 is determined not to be equal to or more than the predetermined value (step S302; NO), the controller 11 outputs a halftone pattern as a test chart separately from the input image data (Step S303). The halftone pattern to be output herein is, for example, an image composed entirely of pixels having a single halftone density. In outputting such a halftone pattern, the controller 11 causes the power supply 25 to apply the second bias.

Next, the controller 11 determines whether there is density unevenness in the output halftone pattern (step S304). For example, the controller 11 causes the density detection sensor 43 to detect density data of the halftone pattern, and determines whether there is density unevenness based on the detected density data. When it is determined that there is density unevenness (step S304; YES), the controller 11 causes the power supply 25 to apply the first bias (step S307).

When it is determined that there is no density unevenness (step S304; NO), the controller 11 determines whether there is potential unevenness in the output halftone pattern (step S305). For example, the controller 11 causes the potential detection sensor 44 to detect the surface potential of the photoreceptor 211 to which the halftone pattern is output, and determines whether there is potential unevenness based on the detected surface potential. When it is determined that there is potential unevenness (step S305; YES), the controller 11 causes the power supply 25 to apply the first bias (step S307).

When it is determined that there is no potential unevenness (step S305; NO), the controller 11 causes the power supply 25 to apply the second bias (step S306).

In such manners, the controller 11 performs the third bias selection process illustrated in FIG. 10.

As described above, the image forming apparatus 1 according to the embodiment provided with the charging roller 212 to charge the surface of the photoreceptor 211 includes the power supply 25 configured to apply to the charging roller 212 the first bias in which an AC voltage is superimposed on a DC voltage or the second bias which is a simple DC voltage, and the controller 11 configured to cause the power supply 25 to apply the first bias until the amount used of the photoreceptor 211 reaches the predetermined value, and cause the power supply 25 to apply the second bias when the amount used of the photoreceptor 211 reaches the predetermined value. Therefore, it is possible to suppress deterioration of image quality due to overdischarge, and when using a thick photoreceptor, it is possible to suppress wastage of the photoreceptor.

The controller 11 determines whether the amount used of the photoreceptor 211 has reached the predetermined value based on the detected film thickness of the photoreceptor 211. Therefore, it is possible to detect the amount used of the photoreceptor 211 more accurately and to suppress deterioration of image quality and wastage of the photoreceptor 211 more reliably.

In a case where the controller 11 detects the film thickness of the photoreceptor 211 based on the integrating drive time of the photoreceptor 211, it is possible to detect the film thickness of the photoreceptor 211 more easily and to reduce a load on the controller 11.

In a case where the controller 11 detects the film thickness of the photoreceptor 211 based on the integrating drive time of the photoreceptor 211 and the coverage of the formed image, it is possible to detect the film thickness of the photoreceptor 211 more accurately and to suppress deterioration of image quality and wastage of the photoreceptor 211 more reliably.

The controller 11 detects the film thickness of the photoreceptor 211 based on the integration of time when the power supply 25 applies the first bias, the integration of time when the power supply 25 applies the second bias, and the coverage of the formed image. Therefore, it is possible to detect the film thickness of the photoreceptor 211 more accurately and to suppress deterioration of image quality and wastage of the photoreceptor 211 more reliably.

Furthermore, the controller 11 functions as a print mode selector that selects a print mode and causes the power supply 25 to apply the second bias even before the amount used of the photoreceptor 211 reaches the predetermined value when the selected print mode is the character mode. Therefore, it is possible to suppress wastage of the photoreceptor 211 further.

The controller 11 causes the power supply 25 to apply the second bias even before the amount used of the photoreceptor 211 reaches the predetermined value when input image data includes no halftone pattern. Therefore, it is possible to suppress wastage of the photoreceptor 211 further.

The controller 11 also functions as a density-unevenness detector that detects density unevenness of a toner image on the photoreceptor 211 or on the intermediate transfer belt 22 by the density detection sensor 43, and outputs a halftone pattern. When the density unevenness is detected in the halftone pattern on the photoreceptor 211 or on the intermediate transfer belt 22, the controller 11 causes the power supply 25 to apply the first bias even after the amount used of the photoreceptor 211 has reached the predetermined value. Therefore, it is possible to suppress wastage of the photoreceptor 211 further.

The controller 11 also functions as a potential-unevenness detector that detects potential unevenness of an electrostatic latent image on the photoreceptor 211 by the potential detection sensor 44, and outputs a halftone pattern. When potential unevenness is detected in the electrostatic latent image of the halftone pattern on the photoreceptor 211, the controller 11 causes the power supply 25 to apply the first bias even after the amount used of the photoreceptor 211 has reached the predetermined value. Therefore, it is possible to suppress wastage of the photoreceptor 211 further.

The image forming apparatus 1 also includes the temperature detector 41 that detects a temperature, and the controller 11 causes the power supply 25 to apply the first bias even after the amount used of the photoreceptor 211 has reached the predetermined value when the temperature detected by the temperature detector 41 is less than the predetermined value. Accordingly, it is possible to suppress deterioration of image quality due to overdischarge more reliably.

Furthermore, the image forming apparatus 1 includes the temperature detector 41 that detects a temperature, and the controller 11 causes the power supply 25 to apply the second bias even before the amount used of the photoreceptor 211 reaches the predetermined value when the temperature detected by the temperature detector 41 is equal to or more than the predetermined value. Therefore, it is possible to suppress wastage of the photoreceptor 211 further.

The image forming apparatus 1 also includes the humidity detector 42 that detects humidity, and the controller 11 causes the power supply 25 to apply the first bias even after the amount used of the photoreceptor 211 has reached the predetermined value when the humidity detected by the humidity detector 42 is equal to or more than the predetermined value. Accordingly, it is possible to suppress deterioration of image quality due to overdischarge more reliably.

Furthermore, the image forming apparatus 1 includes the humidity detector 42 that detects humidity, and the controller 11 causes the power supply 25 to apply the second bias even before the amount used of the photoreceptor 211 reaches the predetermined value when the humidity detected by the humidity detector 42 is less than the predetermined value. Therefore, it is possible to suppress wastage of the photoreceptor 211 further.

Still further, the controller 11 functions as a speed adjuster that adjusts printing speed, and the controller 11 causes the power supply 25 to apply the second bias even before the amount used of the photoreceptor 211 reaches the predetermined value when the printing speed is equal to or less than the predetermined value. Therefore, it is possible to suppress wastage of the photoreceptor 211 further.

The controller 11 switches the first bias or the second bias of the power supply 25 before executing a job and does not switch the first bias or the second bias of the power supply 25 while executing the job. Therefore, it is possible to improve productivity of the image forming apparatus 1.

The above description in the embodiment is an example of a preferable image forming apparatus according to the present invention, and the present invention is not limited thereto.

For example, the first to third bias selection processes illustrated in FIG. 7, FIG. 8 and FIG. 10 in the embodiment are examples, and the present invention is not limited thereto. Contents of the first to third bias selection processes may be combined appropriately.

In the embodiment, the temperature detector 41 and the humidity detector 42 are provided in the vicinity of the photoreceptor 211Y, but the present invention is not limited thereto. The temperature detector 41 and the humidity detector 42 may be provided to any positions as long as the temperature and the humidity inside the image forming apparatus 1 can be detected.

In the embodiment, each bias selection process is performed based on the temperature and the humidity detected by the temperature detector 41 and the humidity detector 42. However, each bias selection process may be performed based on a temperature and humidity detected by a temperature sensor and a humidity sensor (which are not illustrated) provided in the vicinity of the secondary transfer unit 23. In this case, the temperature detector 41 and the humidity detector 42 may not be provided.

In the embodiment, the density detection sensor 43 is provided in the vicinity of the intermediate transfer belt 22, but the invention is not limited thereto. For example, the density detection sensor 43 may be provided in the vicinity of at least one of the photoreceptors 211Y to 211K.

In the embodiment, the charging roller 212 is formed so as to contact with the surface of the photoreceptor 211, but the present invention is not limited thereto. For example, the charging roller 212 may be formed, involving a gap of about 30 to 100 μm between the photoreceptor 211.

In the embodiment, the charging roller 212 provided with the conductive elastic layer 212*b* on the outer periphery of the conductive shaft 212*a* serves as a charging member, but the present invention is not limited thereto. A brush provided with conductive fibers on the outer periphery of the conductive shaft 212*a* may serve as a charging member.

In the embodiment described above, the first to third bias selection processes are performed before executing a job, but the present invention is not limited to this procedure. An active job may be temporarily interrupted so as to perform the first to third bias selection processes.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus provided with a charging member to charge a surface of a photoreceptor, the image forming apparatus comprising:

a power supply that applies to the charging member a first bias in which an AC voltage is superimposed on a DC voltage or a second bias which is only a DC voltage; and a hardware processor that, during user requested image formation, causes the power supply to apply the first bias until an amount used of the photoreceptor reaches a predetermined value, and causes the power supply to apply the second bias when the amount used of the photoreceptor reaches the predetermined value.

2. The image forming apparatus according to claim 1, further comprising a film thickness detector that detects a film thickness of the photoreceptor, wherein the hardware processor determines whether the amount used of the photoreceptor has reached the predetermined value based on the film thickness detected by the film thickness detector.

3. The image forming apparatus according to claim 2, wherein the film thickness detector detects the film thickness of the photoreceptor based on an integrated drive time of the photoreceptor.

4. The image forming apparatus according to claim 3, wherein the film thickness detector detects the film thickness of the photoreceptor based on the integrated drive time of the photoreceptor and coverage of a formed image.

5. The image forming apparatus according to claim 2, wherein the film thickness detector detects the film thickness of the photoreceptor based on an integration of time when the power supply applies the first bias, an integration of time when the power supply applies the second bias, and coverage of a formed image.

6. The image forming apparatus according to claim 1, further comprising a print mode selector that selects a print mode, wherein the hardware processor causes the power supply to apply the second bias even before the amount used of the photoreceptor reaches the predetermined value when the print mode selected by the print mode selector is a character mode.

7. The image forming apparatus according to claim 1, wherein the hardware processor causes the power supply to apply the second bias even before the amount used of the photoreceptor reaches the predetermined value when input image data includes no halftone pattern.

8. The image forming apparatus according to claim 1, further comprising a density-unevenness detector that detects density unevenness of a toner image on the photoreceptor or on an intermediate transfer belt by a density detection sensor, wherein the hardware processor outputs a halftone pattern, and when the density-unevenness detector detects density unevenness in the halftone pattern on the photoreceptor or on the intermediate transfer belt, the hardware processor causes the power supply to apply the first bias even after the amount used of the photoreceptor has reached the predetermined value.

9. The image forming apparatus according to claim 1, further comprising a potential-unevenness detector that detects potential unevenness of an electrostatic latent image on the photoreceptor by a potential detection sensor, wherein the hardware processor outputs a halftone pattern, and when the potential-unevenness detector detects potential unevenness in the electrostatic latent image of the halftone pattern on the photoreceptor, the hardware processor causes the power supply to apply the first bias even after the amount used of the photoreceptor has reached the predetermined value.

10. The image forming apparatus according to claim 1, further comprising a temperature detector that detects a temperature, wherein the hardware processor causes the power supply to apply the first bias even after the amount used of the photoreceptor has reached the predetermined value when the temperature detected by the temperature detector is less than a predetermined value.

11. The image forming apparatus according to claim 1, further comprising a temperature detector that detects a temperature, wherein the hardware processor causes the power supply to apply the second bias even before the amount used of the photoreceptor reaches the predetermined value when the temperature detected by the temperature detector is equal to or more than a predetermined value.

12. The image forming apparatus according to claim 1, further comprising a humidity detector that detects humidity, wherein the hardware processor causes the power supply to apply the first bias even after the amount used of the photoreceptor has reached the predetermined value when the humidity detected by the humidity detector is equal to or more than a predetermined value.

13. The image forming apparatus according to claim 1, further comprising a humidity detector that detects humidity, wherein the hardware processor causes the power supply to apply the second bias even before the amount used of the photoreceptor reaches the predetermined value when the humidity detected by the humidity detector is less than a predetermined value.

14. The image forming apparatus according to claim 1, further comprising a speed adjuster that adjusts printing speed, wherein the hardware processor causes the power supply to apply the second bias even before the amount used of the photoreceptor reaches the predetermined value when the printing speed is equal to or less than a predetermined value.

15. The image forming apparatus according to claim 1, wherein the hardware processor causes the power supply to switch between the first bias and the second bias before executing a job and does not cause the power supply to switch between the first bias and the second bias while executing the job.

16. A method for controlling an image forming apparatus provided with a charging member that charges a surface of a photoreceptor and a power supply that applies to the charging member a first bias in which an AC voltage is superimposed on a DC voltage or a second bias which is only a DC voltage, the method comprising:

causing the power supply to apply the first bias, during user requested image formation, until an amount used of the photoreceptor reaches a predetermined value; and causing the power supply to apply the second bias, during user requested image formation, when the amount used of the photoreceptor reaches the predetermined value.

* * * * *